US006868895B2

(12) United States Patent
Izu et al.

(10) Patent No.: US 6,868,895 B2
(45) Date of Patent: Mar. 22, 2005

(54) CONTINUOUS CASTING METHOD MANUFACTURING THIN CAST STRIPS AND CONTINUOUS CASTING MACHINE

(75) Inventors: Tadahiro Izu, Hikari (JP); Takashi Arai, Hikari (JP); Mamoru Yamada, Hikari (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 10/474,974

(22) PCT Filed: Apr. 15, 2002

(86) PCT No.: PCT/JP02/03732

§ 371 (c)(1),
(2), (4) Date: Oct. 15, 2003

(87) PCT Pub. No.: WO02/083343

PCT Pub. Date: Oct. 24, 2002

(65) Prior Publication Data

US 2004/0129406 A1 Jul. 8, 2004

(30) Foreign Application Priority Data

Apr. 16, 2001 (JP) ..... 2001-117158

(51) Int. Cl.[7] ..... B22D 11/06
(52) U.S. Cl. ..... 164/480; 164/428
(58) Field of Search ..... 164/480, 428

(56) References Cited

U.S. PATENT DOCUMENTS 5,368,088 A * 11/1994 Furuya et al. ..... 164/415

FOREIGN PATENT DOCUMENTS

| | | | |
|---|---|---|---|
| EP | 760397 A1 | | 3/1997 |
| JP | 60-170562 A | | 9/1985 |
| JP | 60-170562 | * | 9/1985 |
| JP | A-3-66450 | | 3/1991 |
| JP | A-3-198951 | | 8/1991 |
| JP | 4-197560 A | | 7/1992 |
| JP | 4-197560 | * | 7/1992 |
| JP | 6-593 A | | 1/1994 |
| JP | 9-122838 | * | 5/1997 |
| JP | 10-263756 | * | 10/1998 |
| JP | 11-267797 | * | 10/1999 |
| JP | 11-267797 A | | 10/1999 |
| WO | WO 93/22087 | * | 11/1993 |

* cited by examiner

*Primary Examiner*—Kuang Y. Lin
(74) *Attorney, Agent, or Firm*—Kenyon & Kenyon

(57) ABSTRACT

In a method of manufacturing a plurality of coil-shaped thin cast strips while molten metal r is being supplied to the molten metal pool 3 formed by a pair of cooling drums 1, 1 and a pair of side dams, when a casting operation corresponding to one coil of the coil-shaped thin cast strip has been completed, gas is made to blow from the gas nozzles 7*b* toward the scum s floating on the molten metal, so that the scum s drifts, due to the gas flow to one meniscus m2, and the thus drifted scum is attached to a surface of the cast strip and circumferential faces of the cooling drums and is then discharged from the molten metal pool.

1 Claim, 5 Drawing Sheets

CONTINUOUS CASTING METHOD MANUFACTURING THIN CAST STRIPS AND CONTINUOUS CASTING MACHINE

TECHNICAL FIELD

The present invention relates to a method and machine for manufacturing thin cast strips, 1 to 10 mm thick, by means of continuous casting. More particularly, the present invention relates to the discharge processing of scum floating on a molten metal surface in a molten metal pool.

BACKGROUND ART

As a method for manufacturing thin cast strips by means of continuous casting, there is provided a twin drum type continuous casting method described as follows. While molten metal is being supplied to a molten metal pool formed by a pair of cooling drums, which are rotated in the opposite direction to each other, and by a pair of side dams which are pressed against both end faces of these cooling drums, solidified shells are formed on the circumferential faces of the respective cooling drums which are being rotated, and the thus formed solidified shells are compressed to each other at the kissing point formed between the cooling drums so that the solidified shells are formed into a thin cast strip, which is wound into a coil on the downstream side.

Non-metallic inclusions such as slag are mixed in the molten metal supplied to the molten metal pool. Further, on a surface of the molten metal, metallic oxides are generated by oxidation. The thus generated non-metallic inclusions and metallic oxides are formed into a scum floating on the surface of the molten metal in the molten metal pool and caught from the meniscuses by the circumferential faces of the cooling drums and onto the surface of the cast strip. As a result, in the portion into which the scum has been caught, cooling of the cast strip is delayed and, further, the cast strip can not be cooled uniformly. Accordingly, problems such as cracks, non-uniformity of structure and unevenness of acid pickling are caused. Further, unevenness of gloss is caused on products.

As a method of preventing the surface of molten metal in the molten metal pool from being oxidized, there is conventionally provided a method in which the molten metal pool is covered with a seal chamber, and non-oxidizing gas such as inert gas is supplied into the seal chamber so as to seal the molten metal face. This method is disclosed, for example, in Japanese Unexamined Patent Publication No. 3-198951. However, even when the molten metal face is sealed by this method, it is impossible to sufficiently prevent the generation and formation of scum.

On the other hand, as a method of preventing scum from being caught onto the circumferential faces of the drums and onto the surface of the cast strip, there is provided a conventional method in which a pair of scum dams extending in the width direction of the drums are arranged on both sides of a molten metal pouring nozzle being dipped in the molten metal so that the flow of scum to the cooling drum side can be prevented by the scum dams. This technique is disclosed, for example, in Japanese Unexamined Patent Publication No. 3-66450. However, even when the scum dams are provided as described above, it is impossible to prevent scum, which has been generated and formed in the periphery of the meniscus between the scum dams and the cooling drums, from being caught by the surfaces of the drums.

Especially, it is a problem that the scum is unevenly caught in the width direction of the cast strip. When a quantity of scum is large, there is a tendency that the scum is unevenly caught. When the casting time increases, the quantity of scum generated and formed is increased. Therefore, in the case where casting work is performed over a long period of time so as to enhance the productivity, the quantity of scum generated and formed is increased and the thus generated and formed scum tends to be unevenly caught.

SUMMARY OF THE INVENTION

It is a task of the present invention to prevent scum from being caught by the circumferential faces of drums and onto a surface of a cast strip by discharging scum floating in a molten metal pool from the molten metal pool in a method of manufacturing thin cast strips by means of continuous casting.

In order to solve the above problems, (1) the present invention provides a continuous casting method for manufacturing thin cast strips, in which a pair of scum dams extending in a drum width direction arranged on both sides of a molten metal pouring nozzle are arranged by being dipped in molten metal in molten metal pool formed by a pair of cooling drums and a pair of side dams, a thin cast strip is cast while molten metal is being supplied into the molten metal pool, and the thin cast strip is wound into a coil so as to manufacture a plurality of coil-shaped thin cast strips, the continuous casting method for manufacturing thin cast strips comprising the step of pulling up the scum dams from the molten metal when casting work, corresponding to one coil of the thin cast strip, is completed.

(2) The present invention provides another continuous casting method for manufacturing thin cast strips, in which a thin cast strip is cast while molten metal is being supplied into a molten metal pool formed by a pair of cooling drums and a pair of side dams, and the thin cast strip is wound into a coil so as to manufacture a plurality of coil-shaped thin cast strips, the continuous casting method for manufacturing thin cast strips comprising the step of blowing gas onto a molten metal face in the molten metal pool toward one of the pair of cooling drums or both of the pair of cooling drums when the casting work, corresponding to one coil of the thin cast strip, is completed.

In order to solve the above problems, (3) the present invention provides a continuous casting machine for manufacturing thin cast strips, in which a thin cast strip is cast while molten metal is being supplied into a molten metal pool formed by a pair of cooling drums and a pair of side dams, and the thin cast strip is wound into a coil so as to manufacture a plurality of coil-shaped thin cast strips, the continuous casting machine for manufacturing thin cast strips comprising gas nozzles to blow gas, which are arranged at an upper central portion of the molten metal pool, being directed toward one or both of the pair of cooling drums, to a molten metal face of the molten metal pool when casting operation corresponding to one coil of the thin cast strip has been completed.

BRIEF DESCRIPTION OF THE DRAWINGS

FIG. 1(*a*) is a view showing a state in which continuous casting is steadily performed, and FIG. 1(*b*) is a view showing a state in which scum is discharged.

THE MOST PREFERRED EMBODIMENT

Figure 1:
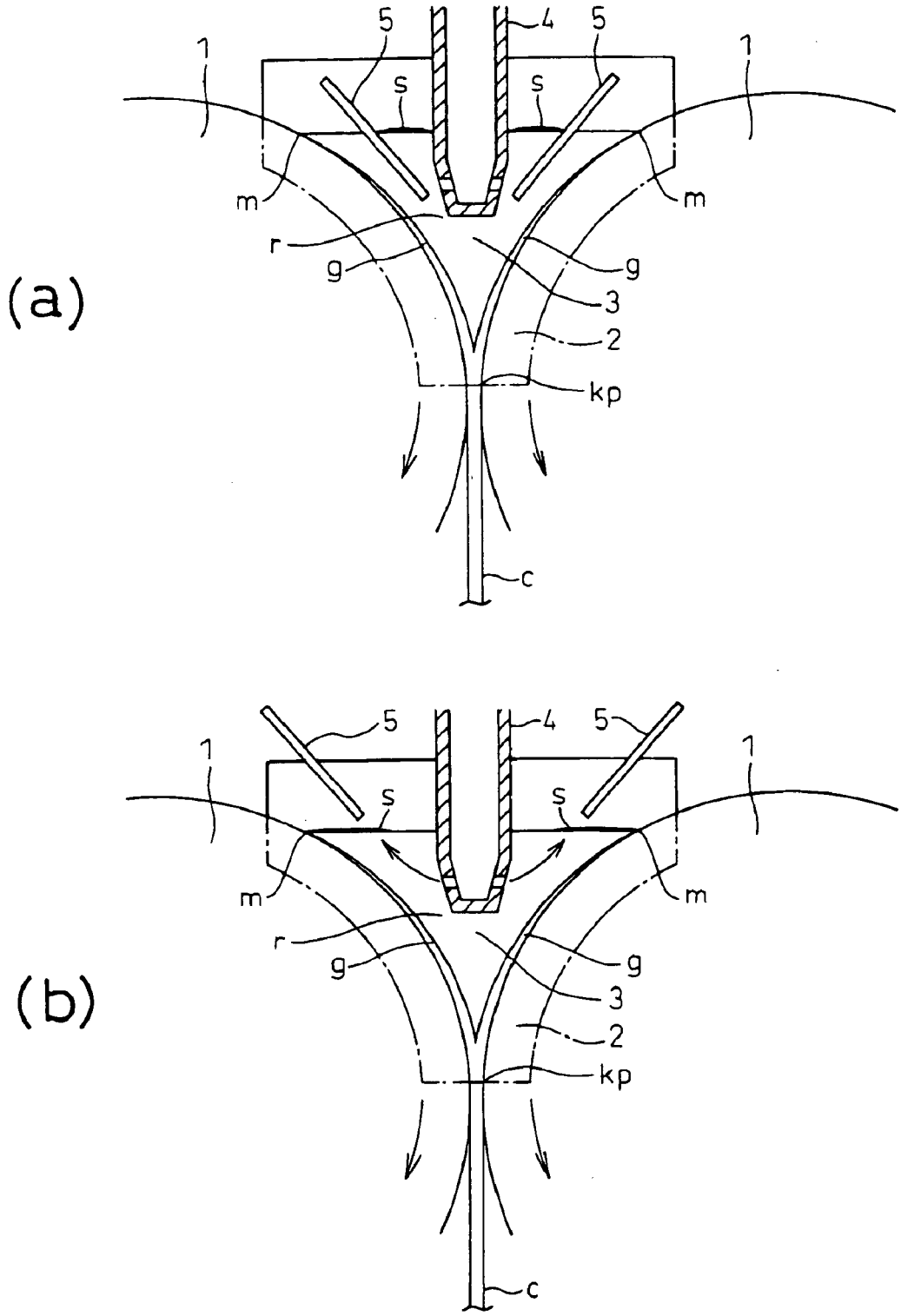
FIG. 1 is a sectional side view for explaining an embodiment according to claim 1 of the invention.

An embodiment of the present invention, in which a twin drum type continuous casting machine is used, will be explained as follows. FIGS. 1(*a*) and 1(*b*) are sectional side views for explaining an embodiment according to claim 1 of the invention.

A pair of side dams 2, 2 are pressed against both end faces of a pair of cooling drums 1, 1 which are rotated in the opposite direction to each other.

In the view, only one of the pair of side dams 2, 2 is shown by a virtual line. Therefore, the molten metal pool 3 is formed by the pair of cooling drums 1, 1 and the pair of side dams 2, 2.

Molten metal r is supplied from a tundish (not shown) into the molten metal pool 3 via the molten metal pouring nozzle 4. An upper portion of the molten metal pool 3 is covered with a seal chamber (not shown) for preventing the generation and formation of scum caused when a surface of molten metal is oxidized, and non-oxidizing gas such as argon or nitrogen is supplied into the seal chamber.

Molten metal r in the molten metal pool 3 is cooled by the circumferential faces of the pair of cooling drums 1, 1, and a pair of solidified shells g, g are formed. The pair of solidified shells g, g are compressed at the kissing point kp of the drum and are formed into the thin cast strip c and then moved downward.

The thin cast strip c is wound by a coiler (not shown), which is arranged on the downstream side, into a coil. When the weight of the thus wound thin cast strip has reached a predetermined value, the winding operation is stopped and the thin cast strip c is successively wound by another coiler. In this way, a plurality of coil-shaped thin cast strips are manufactured.

A non-oxidizing gas such as argon or nitrogen is supplied into the seal chamber that covers the upper portion of the molten metal pool 3 so as to prevent the generation and formation of scum which is generated and formed by oxidation of the surface of molten metal, however, it is impossible to sufficiently prevent the generation and formation of scum.

In order to prevent the scum from being caught on the surface of the cast strip, as shown in FIG. 1(*a*), there are provided a pair of scum dams 5, 5 extending in the drum width direction being arranged on both sides of the molten metal pouring nozzle 4, and the pair of scum dams 5, 5 are dipped in molten metal, so that the scum s floating on the molten metal surface can be prevented from flowing to the drum side.

In the process of casting, from the sectional size of the cast strip, specific gravity of the cast strip and the casting speed, the weight of the thin cast strip, which has been moved from the kissing point kp of the twin drums, is calculated in real time.

When the thus calculated weight has reached a weight corresponding to one coil and casting operation per one coil has been completed, the pair of scum dams 5, 5 are pulled up from the molten metal as shown in FIG. 1(*b*).

After the scum dams 5, 5 have been pulled up, scum s floating on the molten metal surface is made to flow to the cooling drum side by a current of molten metal and it drifts to the meniscuses m.

At this time, as the cooling drums are continuously rotated, the scum s which has drifted to the meniscuses m is caught by the circumferential faces of the drums and by the surface of the cast strip, and discharged from the molten metal pool 3.

Figure 2:
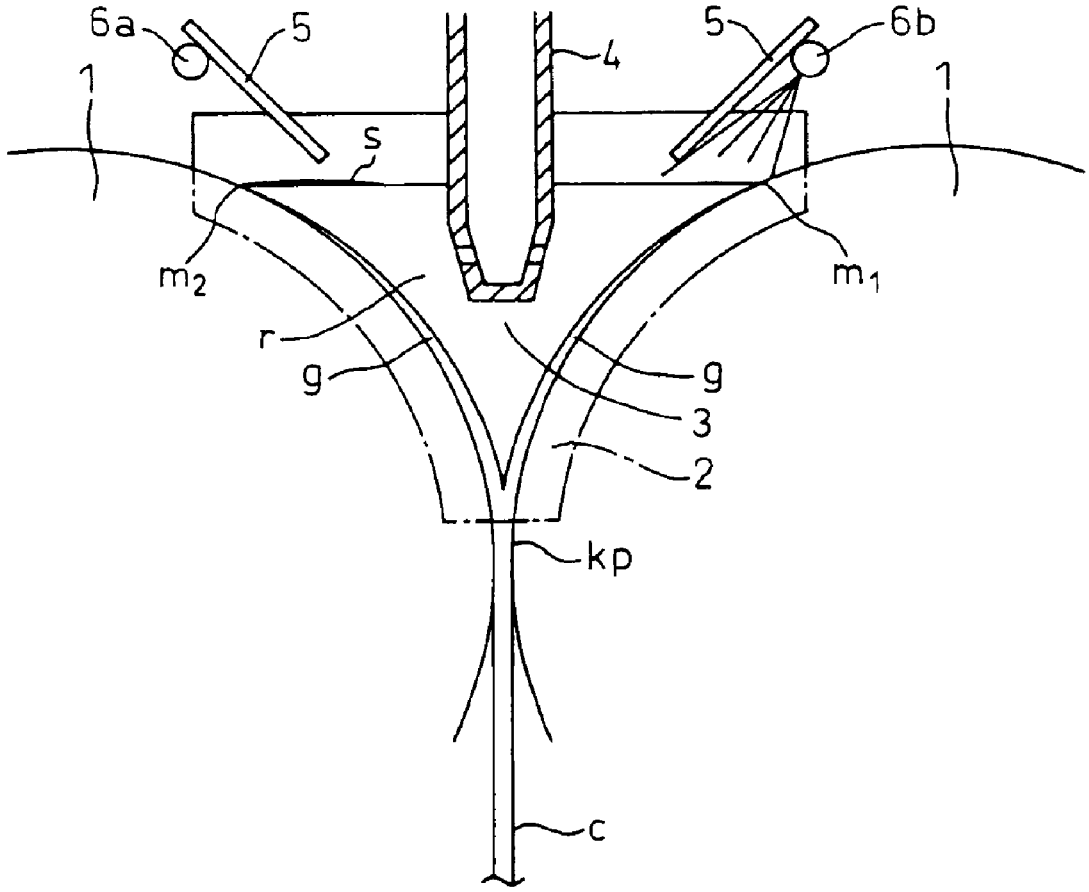
FIG. 2 is a sectional side view for explaining an embodiment according to claims 2 and 3 of the invention. This view shows a mode in which scum is discharged.
Figure 3:
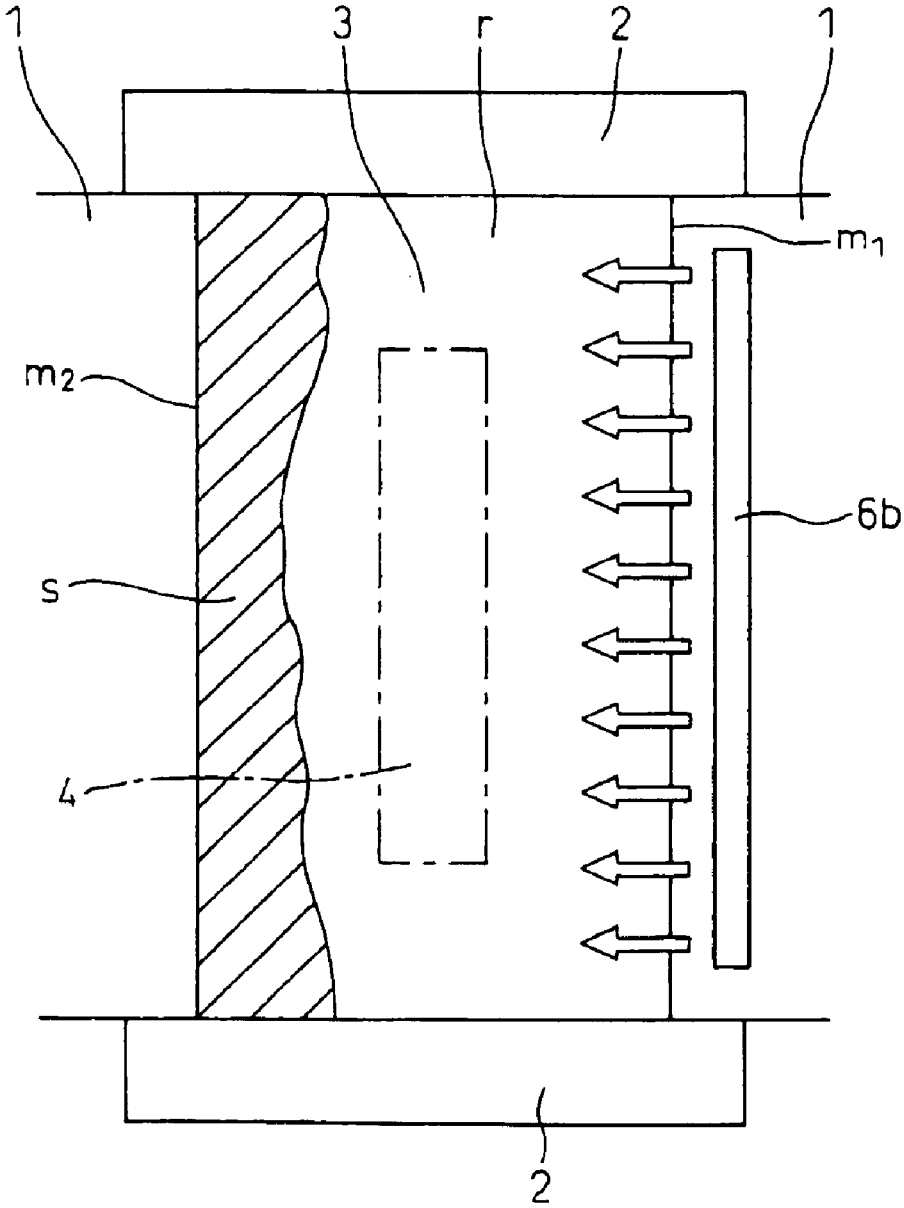
FIG. 3 is a plan view of FIG. 2.

FIGS. 2 and 3 are sectional side views for explaining an embodiment according to the other features of the invention. Like reference characters are used to indicated like parts in FIG. 1. In an upper portion of the molten metal pool 3, there is provided a seal chamber (not shown), which is supplied with non-oxidizing gas.

In the view, there is shown a mode in which the pair of scum dams 5, 5 are pulled up from the molten metal. However, in the process of casting, the pair of scum dams 5, 5 are dipped in the molten metal r, so that the scum s can be prevented from flowing to the meniscuses m1 and m2.

On the back faces of the scum dams 5, 5, there are provided gas nozzles 6*a* and 6*b* for blowing non-oxidizing gas to the molten metal in the molten metal pool, wherein the gas nozzles 6*a* and 6*b* are directed from the sides of the meniscuses m1 and m2 to the molten metal pouring nozzle 4.

Concerning the type of the gas nozzles 6*a* and 6*b*, any type gas nozzles such as slit type gas nozzles or circular hole type gas nozzles may be used. In the case of the slit type gas nozzle, the dimensions of an exemplary nozzle are described as follows. The width is 1.5 mm, the length is 18 mm, the distance to the molten metal face is 60 to 70 mm (in the case where the scum dams are being dipped in molten metal).

In the case of the circular hole type gas nozzle, the dimensions of an exemplary nozzle are described as follows. The nozzle diameter is 0.5 to 1.0 mm, the hole pitch is 5 mm and the distance to the molten metal face is 80 mm.

The height of the gas nozzle and the injection angle can be adjusted according to the height of the molten metal face. The rate of flow is 20 to 30 mps in the case of the slit type nozzle and of the circular hole type nozzle.

In the same manner as that of FIG. 1, in FIGS. 2 and 3, the thin cast strip c is wound by a coiler (not shown), which is arranged on the downstream side, into a coil-shape. When the weight of the thus wound thin cast strip has reached a predetermined value, the winding operation is stopped and the thin cast strip c is successively wound by another coiler (not shown).

In this way, a plurality of coil-shaped thin cast strip are manufactured.

In the process of continuous casting, the scum dams 5, 5 are dipped in the molten metal r in the molten metal pool 3 so that the flows of scums to the meniscuses m1 and m2 are blocked and scum s is prevented from being caught on the circumferential faces of the drums and the surface of the cast strip. From the gas nozzles 6*a* and 6*b*, non-oxidizing gas such as nitrogen or argon is blown out from the circumferential faces of the drums, before the meniscuses m1 and m2, and toward the scum dams 5.

Therefore, the scum floating between the scum dam 5 and the meniscuses m1 and m2 is blown by gas to the scum dam 5 and, further, blown to the side dams. In this way, the scum is prevented from being caught by the meniscuses m1 and m2.

In the process of casting, from the sectional size of the cast strip, the specific gravity of the cast strip and the casting speed, the weight of the thin cast strip, which has been moved from the kissing point kp of the twin drums, is calculated in real time. When the thus calculated weight has reached a weight corresponding to one coil and a casting operation for one coil has been completed, the pair of scum dams 5, 5 are pulled up from the molten metal as shown in FIG. 2. At the same time, from one gas nozzle 6*b*, which the right gas nozzle in the case shown in the drawing, of the gas nozzles 6*a*, 6*b*, non-oxidizing gas is blown out.

The scum s floating on the molten metal surface drifts from one meniscus m1 to the other meniscus m2. As the cooling drums 1, 1 are successively rotated at this time, the scum s which has drifted to the meniscus m2 is caught on the circumferential faces of the drums and the surface of the cast strip and discharged from the molten metal pool 3.

In this connection, in this embodiment, the gas nozzles 6*a*, 6*b* are attached to the scum dams 5, however, the gas nozzles 6*a*, 6*b* may be arranged separate from the scum dams 5.

Figure 4:
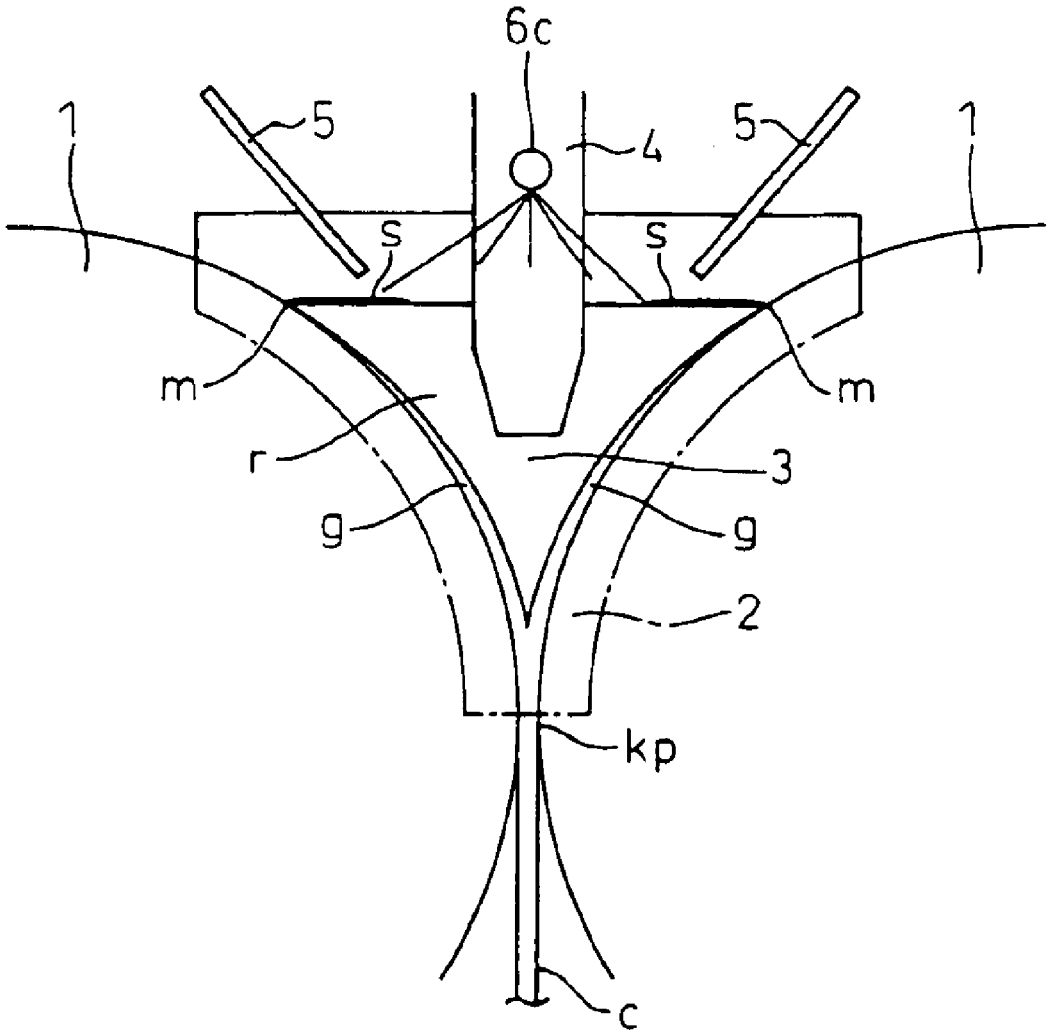
FIG. 4 is a sectional side view for explaining another embodiment according to claims 2 and 3 of the invention. This view shows a mode in which scum is discharged.
Figure 5:
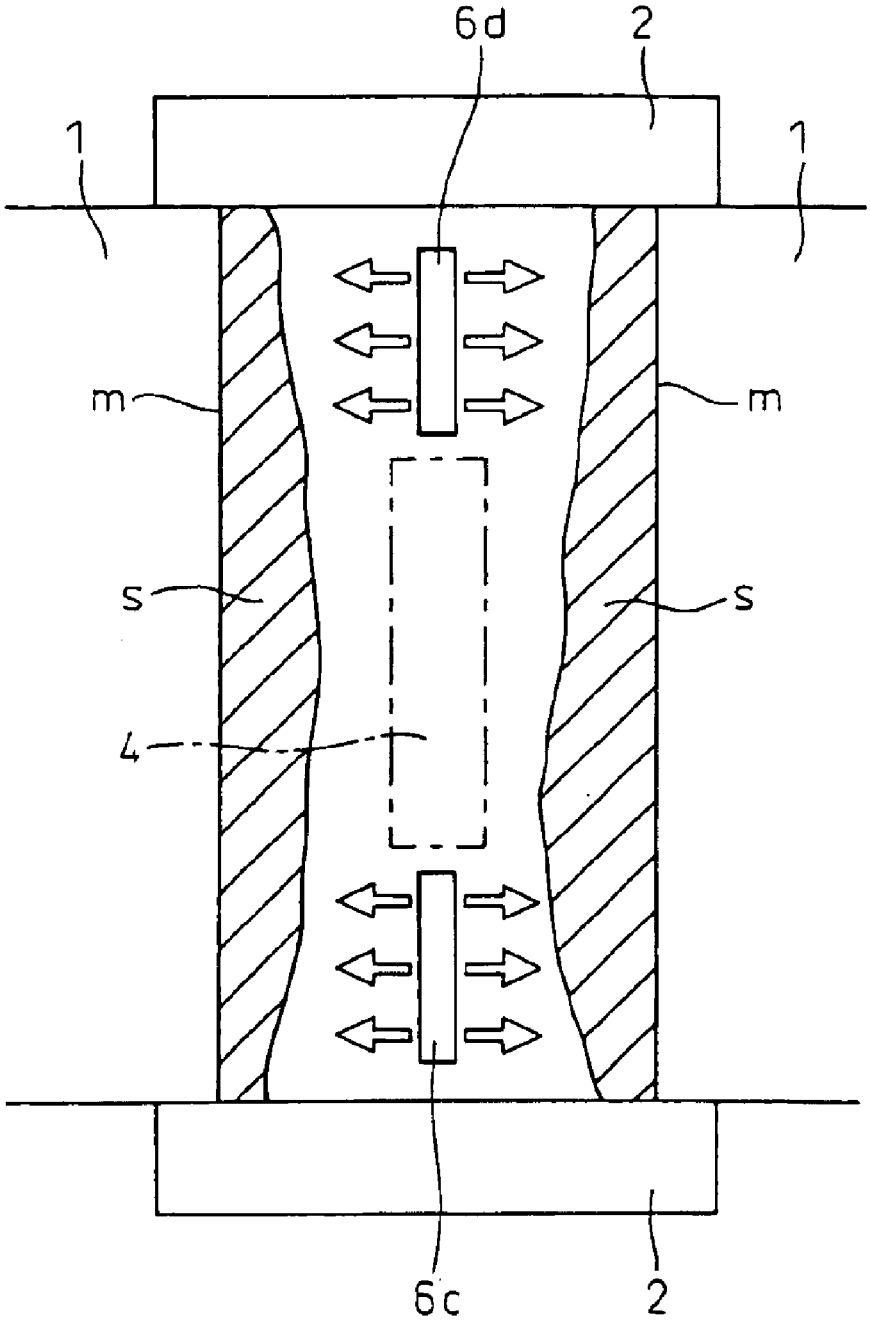
FIG. 5 is a plan view of FIG. 4.

FIGS. 4 and 5 are views showing another embodiment according to claims 2 and 3. Different points of this embodiment from the embodiment shown in FIGS. 2 and 3 are described as follows. In the embodiment shown in FIGS. 2 and 3, gas is made to blow out to only one of the meniscuses, however, in this embodiment shown in FIGS. 4 and 5, gas is made to blow out to both meniscuses.

On both sides of the molten metal pouring nozzle 4, there are provided gas nozzles 6*c*, 6*d* from which gas is made to blow out from the central portion of the molten metal pool 3 to both meniscuses m, m.

In the same manner as that shown in FIGS. 2 and 3, in the method of manufacturing a plurality of coil-shaped thin cast strips, when the calculated weight of a cast strip has reached a value corresponding to the weight of one coil and a casting operation of one coil has been completed, the scum dams 5, 5 are pulled up from molten metal r and non-oxidizing gas is made to blow out from the gas nozzles 6*c*, 6*d*.

When non-oxidizing gas blows out as described above, the scum s floating on the molten metal surface drifts, due to the non-oxidizing gas flow, toward both meniscuses m, m.

In the same manner as that described before, as the cooling drums 1, 1 are successively rotated at this time, the scum s, which has drifted to the meniscuses m, m, is caught on the circumferential faces of the rotating drums and the surface of the cast strip, and discharged from the molten metal pool 3.

In this connection, in the method of the present invention, flaws, which are caused by the scum, exist in a portion of the cast strip in which the scum is being caught. Therefore, in many cases, this portion of the cast strip is defective so that it is impossible to supply this portion of the cast strip as a product.

However, flaws are usually generated and formed in a top portion and a tail portion of each coil-shaped thin cast strip, wherein the length of the top portion and the length of the tail portion are respectively about 2 to 4 m.

Therefore, these top and tail portions are defective portions which cannot become a product. Accordingly, when the scum is discharged into these defective portions in the process of casting, an additional deterioration of the yield is not caused.

Accordingly, it is preferable that "the time when casting corresponding to one coil of thin cast strip has been completed" described in the method of the present invention is "the time when casting of a product portion of the thin cast strip except for the above defective portions has been completed".

In this connection, the scum may be discharged according to a quantity of the generated scum, that is, the scum may not be necessarily discharged each time a casting corresponding to one coil has been completed.

Next, an example will be explained below.

EXAMPLE

A twin drum type continuous casting machine was used, wherein the diameter of each cooling drum was 1200 mm and the width was 1300 mm. As an example of the present invention, molten metal of 180 ton was continuously cast according to the embodiment shown in FIGS. 2 and 3.

When casting corresponding to one coil was completed, the scum drifted, due to a flow of gas, toward the circumferential faces of the cooling drums and was discharged from the molten metal pool.

In the comparative example, the conventional scum dams were used, however, the scum was not discharged. As a result, the ratio of generation and formation of surface defects, which totally represents the generation and formation of surface cracks and unevenness of gloss, of the comparative example was about five times as high as that of the embodiment of the present invention.

INDUSTRIAL APPLICABILITY

According to the present invention, in the method of casting a thin cast strip by a twin drum type continuous casting machine and winding the thin cast strip into a coil so as to manufacture a plurality of coil-shaped thin cast strips, when casting corresponding to one coil of the thin cast strip has been completed, scum floating on a molten metal surface in a molten metal pool drifts and is collected at the meniscus, so that the scum can be made to adhere onto a surface of the cast strip and circumferential faces of the cooling drums and discharged from the molten metal pool.

Therefore, according to the present invention, no scum is accumulated even in the case of continuous casting performed over a long period of time, and cast strips of high quality can be manufactured.

What is claimed is:

1. A continuous casting method for manufacturing thin cast strips, in which a pair of scum dams extending in a drum width direction arranged on both sides of a molten metal pouring nozzle are arranged by being dipped in molten metal in molten metal pool formed by a pair of cooling drums and a pair of side dams, a thin cast strip is cast while molten metal is being supplied into the molten metal pool, and the thin cast strip is wound into a coil so as to manufacture a plurality of coil-shaped thin cast strips, the continuous casting method for manufacturing thin cast strips comprising the step of pulling up the scum dams from the molten metal when casting work, corresponding to one coil of the thin cast strip, is completed.

* * * * *